US010748468B2

(12) United States Patent
Li et al.

(10) Patent No.: US 10,748,468 B2
(45) Date of Patent: Aug. 18, 2020

(54) DISPLAY PANEL AND DISPLAY DEVICE

(71) Applicant: Shenzhen China Star Optoelectronics Technology Co., Ltd., Shenzhen (CN)

(72) Inventors: Yuntao Li, Shenzhen (CN); Yuyeh Chen, Shenzhen (CN); Yinhung Chen, Shenzhen (CN)

(73) Assignee: Shenzhen China Star Optoelectronics Technology Co., Ltd., Shenzhen (CN)

( * ) Notice: Subject to any disclaimer, the term of this patent is extended or adjusted under 35 U.S.C. 154(b) by 341 days.

(21) Appl. No.: 15/567,092

(22) PCT Filed: Jun. 22, 2017

(86) PCT No.: PCT/CN2017/089605

§ 371 (c)(1),
(2) Date: Oct. 17, 2017

(87) PCT Pub. No.: WO2018/209755

PCT Pub. Date: Nov. 22, 2018

(65) Prior Publication Data

US 2018/0336813 A1 Nov. 22, 2018

(30) Foreign Application Priority Data

May 19, 2017 (CN) ..... 2017 1 0357890

(51) Int. Cl.
*G09G 3/20* (2006.01)
*G09G 3/36* (2006.01)

(52) U.S. Cl.
CPC ..... *G09G 3/2092* (2013.01); *G09G 3/2014* (2013.01); *G09G 3/3674* (2013.01); *G09G 3/3685* (2013.01); *G09G 2300/0452* (2013.01); *G09G 2310/0243* (2013.01); *G09G 2310/08* (2013.01); *G09G 2320/0276* (2013.01)

(58) Field of Classification Search
CPC ..... G09G 3/2092; G09G 2300/0452; G09G 3/3674; G09G 3/3685; G09G 2310/08; G09G 2320/0276; G09G 2310/0243
See application file for complete search history.

(56) References Cited

U.S. PATENT DOCUMENTS

2005/0206638 A1* 9/2005 Wakimoto ..... G09G 3/3648 345/209
2009/0244035 A1 10/2009 Cho et al.
(Continued)

FOREIGN PATENT DOCUMENTS

CN 101118322 3/2008
CN 201812478 4/2011
(Continued)

*Primary Examiner* — Temesghen Ghebretinsae
*Assistant Examiner* — Paras D Karki

(57) ABSTRACT

A display panel is provided. The display panel includes a plurality of data lines, a plurality of scan lines, and a plurality of pixel units, wherein each of the plurality of pixel units includes a plurality of sub-pixel units; the plurality of sub-pixels in a same pixel unit are connected to a same data line, and are correspondingly connected to different scan lines. The display panel includes a data driving module and a scan driving module. The data driving module includes a pulse width modulating chip, a gamma correcting chip, a timing control chip, and a data signal generating chip. A display device is also provided.

17 Claims, 2 Drawing Sheets

(56) References Cited

U.S. PATENT DOCUMENTS

| | | | | |
|---|---|---|---|---|
| 2011/0001749 | A1* | 1/2011 | Min | G09G 3/3688 345/214 |
| 2015/0187300 | A1 | 7/2015 | Sun et al. | |
| 2016/0133179 | A1* | 5/2016 | Choi | G09G 3/2092 345/212 |
| 2016/0351133 | A1* | 12/2016 | Kim | G09G 3/3406 |
| 2017/0148400 | A1 | 5/2017 | Chen et al. | |
| 2017/0256231 | A1* | 9/2017 | Takahashi | G09G 5/008 |
| 2017/0263170 | A1* | 9/2017 | Mu | G09G 3/3614 |

FOREIGN PATENT DOCUMENTS

| | | |
|---|---|---|
| CN | 103745703 | 4/2014 |
| CN | 105185324 | 12/2015 |
| CN | 106297721 | 1/2017 |

* cited by examiner

DISPLAY PANEL AND DISPLAY DEVICE

RELATED APPLICATIONS

This application is a National Phase of PCT Patent Application No. PCT/CN2017/089605 having International filing date of Jun. 22, 2017, which claims the benefit of priority of Chinese Patent Application No. 201710357890.5 filed on May 19, 2017. The contents of the above applications are all incorporated by reference as if fully set forth herein in their entirety.

FIELD AND BACKGROUND OF THE INVENTION

The present disclosure relates to a technical field of display panel designs, and more particularly to a display panel and a display device.

With the development of technology, people are demanding more and more from display devices, particularly in aspects of stability and volume size.

Existing liquid crystal display devices generally work with data lines and scan lines crossing each other. An existing full high definition liquid crystal display device (TFT_LCD_FHD) has a resolution of 1920*1080 pixels. The existing full high definition liquid crystal display device adopts a signal driving structure driving and displaying generally with 1920*3 data lines and 1080 scan lines. Because there are more of data lines, it increases volume of a data driving chip, thereby causing entire volume of the display device, particularly border volume of the display device to increase.

Therefore, it is desired to provide a display panel and a display device to solve a problem of the related art.

SUMMARY OF THE INVENTION

Embodiments of the present disclosure provide a display panel and a display device having small volume, a simple structure, and a low cost, so as to solve a technical problem of the existing display panel and display device which have larger volume, a more complicated driving circuit structure, and higher manufacturing cost.

An embodiment of the present disclosure provides a display panel, including a plurality of data lines, a plurality of scan lines, and a plurality of pixel units formed by crossing the plurality of data lines and the plurality of scan lines, wherein each of the plurality of pixel units includes a plurality of sub-pixel units; the plurality of sub-pixels in a same pixel unit are connected to a same data line, and are correspondingly connected to different scan lines.

The display panel further includes a data driving module configured to provide corresponding data signals to the plurality of data lines, and a scan driving module configured to provide corresponding scan signals to the plurality of scan lines.

The data driving module includes a pulse width modulating chip configured to control pulse widths of the data signals, a gamma correcting chip configured to control signal intensities of the data signals, so as to adjust a frame displaying parameter, a timing control chip configured to control timing of producing the data signals, and a data signal generating chip configured to generate the data signals.

The pulse width modulating chip and the gamma correcting chip are disposed on a printed circuit board, the timing control chip and the data signal generating chip are disposed on a flexible circuit board, and the printed circuit board is connected to the plurality of data lines through the flexible circuit board.

The plurality of sub-pixels in the same pixel unit are disposed along an extending direction of the data line An embodiment of the present disclosure still provides a display panel including a plurality of data lines, a plurality of scan lines, and a plurality of pixel units formed by crossing the plurality of data lines and the plurality of scan lines, wherein each of the plurality of pixel units includes a plurality of sub-pixel units; the plurality of sub-pixels in a same pixel unit are connected to a same data line, and are correspondingly connected to different scan lines.

The display panel further includes a data driving module configured to provide corresponding data signals to the plurality of data lines, and a scan driving module configured to provide corresponding scan signals to the plurality of scan lines.

The data driving module includes a pulse width modulating chip configured to control pulse widths of the data signals, a gamma correcting chip configured to control signal intensities of the data signals, so as to adjust a frame displaying parameter, a timing control chip configured to control timing of producing the data signals, and a data signal generating chip configured to generate the data signals.

In the display device of the present disclosure, the pulse width modulating chip and the gamma correcting chip are disposed on a printed circuit board, the timing control chip and the data signal generating chip are disposed on a flexible circuit board, and the printed circuit board is connected to the plurality of data lines through the flexible circuit board.

In the display device of the present disclosure, the plurality of sub-pixels in the same pixel unit are disposed along an extending direction of the data line.

In the display device of the present disclosure, each of the plurality of pixel units includes a red sub-pixel unit, a blue sub-pixel unit, and a green sub-pixel unit.

In the display device of the present disclosure, the display panel has a resolution of 1920*1080 pixels, and the display panel includes 1920 data lines and 3240 scan lines.

In the display device of the present disclosure, the scan driving module includes 6 scan signal generating chips each of which has 540 channels, and the data driving module includes 2 data signal generating chips each of which has 960 channels.

In the display device of the present disclosure, the timing control chip and the data signal generating chip are disposed on the flexible circuit board in a chip-on-film form.

In the display device of the present disclosure, the timing control chip communicates with the data signal generating chip using a P2P protocol.

In the display device of the present disclosure, the timing control chip communicates with the data signal generating chip using a mini-LVDS protocol.

An embodiment of the present disclosure still provides a display device including a display panel, wherein the display panel includes a plurality of data lines, a plurality of scan lines, and a plurality of pixel units formed by crossing the plurality of data lines and the plurality of scan lines, wherein each of the plurality of pixel units includes a plurality of sub-pixel units; the plurality of sub-pixels in a same pixel unit are connected to a same data line, and are correspondingly connected to different scan lines.

The display panel further includes a data driving module configured to provide corresponding data signals to the plurality of data lines, and a scan driving module configured to provide corresponding scan signals to the plurality of scan lines.

The data driving module includes a pulse width modulating chip configured to control pulse widths of the data signals, a gamma correcting chip configured to control signal intensities of the data signals, so as to adjust a frame displaying parameter, a timing control chip configured to control timing of producing the data signals, and a data signal generating chip configured to generate the data signals.

In the display device of the present disclosure, the pulse width modulating chip and the gamma correcting chip are disposed on a printed circuit board, the timing control chip and the data signal generating chip are disposed on a flexible circuit board, and the printed circuit board is connected to the plurality of data lines through the flexible circuit board.

In the display device of the present disclosure, the plurality of sub-pixels in the same pixel unit are disposed along an extending direction of the data line.

In the display device of the present disclosure, each of the plurality of pixel units includes a red sub-pixel unit, a blue sub-pixel unit, and a green sub-pixel unit.

In the display device of the present disclosure, the display panel has a resolution of 1920*1080 pixels, and the display panel includes 1920 data lines and 3240 scan lines.

In the display device of the present disclosure, the scan driving module includes 6 scan signal generating chips each of which has 540 channels, and the data driving module includes 2 data signal generating chips each of which has 960 channels.

FIG. 2 is a schematic structural diagram of a pixel unit and a data line and a plurality of scan lines connected to the pixel unit in accordance with a preferred embodiment of the present disclosure.

In the display device of the present disclosure, the timing control chip and the data signal generating chip are disposed on the flexible circuit board in a chip-on-film form.

In the display device of the present disclosure, the timing control chip communicates with the data signal generating chip using a P2P protocol.

In the display device of the present disclosure, the timing control chip communicates with the data signal generating chip using a mini-LVDS protocol.

Compared to the existing display panel and display device, the display panel and the display device of the present disclosure increase the number of the scan lines, thereby effectively decreasing the number of the data lines. Because the number of data lines that gets reduced is more than the number of scan lines that is increased, the number of control chips in the data driving module may be effectively reduced. Meanwhile, the timing control chip and the data signal generating chip in the data driving module are disposed on the flexible circuit board, thereby effectively decreasing volume of the data driving module. Therefore, border volume of the display panel is decreased, and the data driving module has a simple structure and low manufacturing cost. Hence, the technical problem of the existing display panel and display device which have larger volume, a more complicated driving circuit structure, and higher manufacturing cost is effectively solved.

In order for the foregoing content of the present disclosure to be more apparent, the following preferred embodiments with reference to the accompanying drawings are used as examples to provide a detailed description below.

DESCRIPTION OF SPECIFIC EMBODIMENTS OF THE INVENTION

Figure 1:
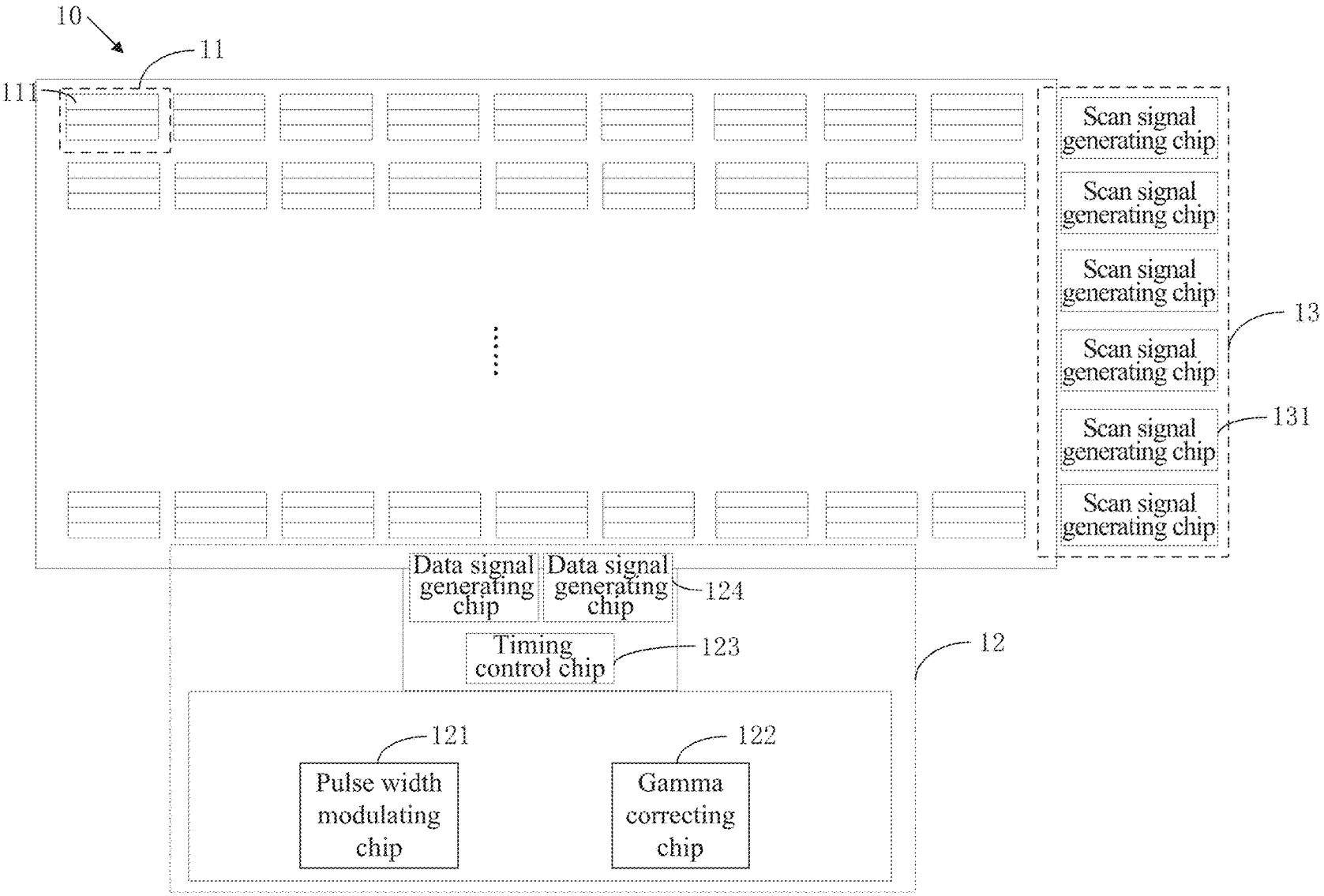
FIG. 1 is a schematic structural diagram of a display panel in accordance with a preferred embodiment of the present disclosure.

Description of each embodiment below refers to respective accompanying drawing(s), so as to exemplarily illustrate specific embodiments of the present disclosure that may be practiced. Directional terms mentioned in the present disclosure, such as "upper", "lower", "front", "back", "left", "right", "inner", "outer", "side", etc., are only directions by referring to the accompanying drawings, and thus the used directional terms are used to describe and understand the present disclosure, but the present disclosure is not limited thereto.

In the drawings, structurally similar units are labeled by the same reference numerals.

Figure 2:
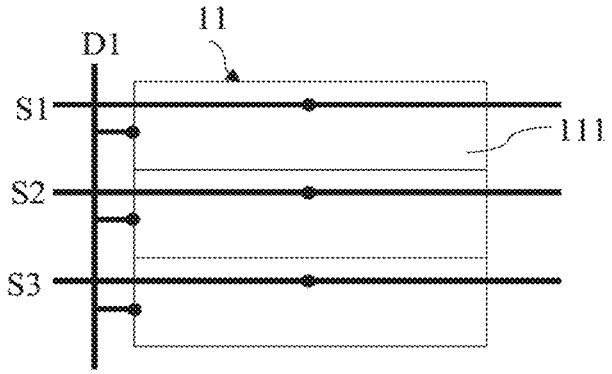

Referring to FIG. 1, FIG. 1 is a schematic structural diagram of a display panel in accordance with a preferred embodiment of the present disclosure. FIG. 2 is a schematic structural diagram of a pixel unit and a data line and a plurality of scan lines connected to the pixel unit in accordance with a preferred embodiment of the present disclosure. A display panel 10, in accordance with a preferred embodiment of the present disclosure, includes a plurality of data lines (not illustrated in FIG. 1), a plurality of scan lines (not illustrated in FIG. 1), and a plurality of pixel units 11 formed by crossing the plurality of data lines and the plurality of scan lines, wherein each of the plurality of pixel units 11 includes a plurality of sub-pixel units 111, such as a red sub-pixel unit, a blue sub-pixel unit, and a green sub-pixel unit. Referring to FIG. 2, the plurality of sub-pixels 111 in a same pixel unit 11 are disposed along an extending direction of a data line D1. The plurality of sub-pixels 111 in the same pixel unit 11 are connected to the same data line D1, and are correspondingly connected to different scan lines S1, S2, and S3.

Referring to FIG. 1, the display panel 10 further includes a data driving module 12 configured to provide corresponding data signals to the plurality of data lines, and a scan driving module 13 configured to provide corresponding scan signals to the plurality of scan lines. The scan driving module 13 includes a plurality of scan signal generating chips 131 configured to generate scan signals.

The data driving module 12 includes a pulse width modulating chip 121, a gamma correcting chip 122, a timing control chip 123, and a data signal generating chip 124. The pulse width modulating chip 121 is configured to control pulse widths of the data signals. The gamma correcting chip 122 is configured to control signal intensities of the data signals, so as to adjust a frame displaying parameter. The timing control chip 123 is configured to control timing of producing the data signals. The data signal generating chip 124 is configured to generate the data signals.

The pulse width modulating chip 121 and the gamma correcting chip 122 are disposed on a printed circuit board. The timing control chip 123 and the data signal generating chip 124 are disposed on a flexible circuit board (such as in a chip-on-film (COF) form). The printed circuit board is connected to the plurality of data lines through the flexible circuit board. Because the timing control chip 123 and the data signal generating chip 124 are disposed on the flexible circuit board, the timing control chip 123 can communicate with the data signal generating chip 124 using a P2P protocol, and also can communicate with the data signal generating chip 124 using a mini-LVDS protocol.

Referring to FIG. 1, the display panel 10 has a resolution of 1920*1080 pixels. Therefore, the display panel 10 includes 1920 data lines and 3240 (i.e. 1080*3) scan lines. In this manner, the scan driving module 13 includes 6 scan signal generating chips 131 each of which has 540 channels, so as to provide the scan signals to the 3240 scan lines. The data driving module 12 includes 2 data signal generating chips 124 each of which has 960 channels, so as to provide the data signals to the 1920 data lines.

When using the display panel 10 in accordance with the embodiment of the present disclosure, the data signal generating chips 124 in the data driving module 12 generate the corresponding data signals under operations of the pulse width modulating chip 121, the gamma correcting chip 122, and the timing control chip 123. The scan signal generating chips 131 in the scan driving module 13 generate the corresponding scan signals.

Each row of sub-pixel units 111 in the display panel 10 is connected to a same corresponding scan line. Referring to FIG. 2 because the plurality of sub-pixels 111 in the same pixel unit 11 are disposed along the extending direction of the data line D1, the plurality of sub-pixels 111 in the same pixel unit 11 are correspondingly connected to the different scan lines S1, S2, and S3. Referring to FIG. 1, in this manner, when the display panel 10 in accordance with the embodiment of the present disclosure displays the frame, by turning on each row of the sub-pixel units 111 row-by-row, and further by inputting a data signal to the plurality of sub-pixels 111 through the data line, a corresponding display is achieved.

In the embodiment of the present disclosure, because the plurality of sub-pixels 111 are vertically disposed in the same pixel unit 11, the entire display panel 10 needs the 1920 data lines and the 3240 scan lines. By increasing the number of the plurality of scan lines, the number of plurality of data lines are significantly decreased, thereby better decreasing border volume on a side of the data driving module 12 in the display panel 10. Meanwhile, the data driving module 12 only needs to dispose the 2 data signal generating chips 124 each of which has the 960 channels. Therefore, manufacturing cost of the data driving module 12 is also lowered.

In addition, because the number of the data signal generating chips 124 is decreased, the preferred embodiment of the present disclosure further can have the data signal generating chips 124 disposed on the flexible circuit board in the COF form, thereby further reducing an area of the printed circuit board in the data driving module 12. By disposing the flexible circuit board, wiring is realized, and an arrangement of the data signal generating chips 124 and the timing control chip 123 is realized. Hence, an entire structure of the data driving module 12 is simple, and manufacturing cost is lower.

In order to facilitate the data signal generating chips 124 and the timing control chip 123 on the flexible circuit board to stably operate, here the timing control chip 123 communicates with the data signal generating chips 124 using the P2P protocol, or communicates with the data signal generating chip 124 using the mini-LVDS protocol.

The display panel of the present disclosure increases the number of the scan lines, thereby effectively decreasing the number of the data lines. Meanwhile, the timing control chip and the data signal generating chip in the data driving module are disposed on the flexible circuit board, thereby effectively decreasing volume of the data driving module. Therefore, border volume of the display panel is decreased, and the data driving module has a simple structure and low manufacturing cost.

The present disclosure still provides a display device including a display panel, wherein the display panel includes a plurality of data lines, a plurality of scan lines, and a plurality of pixel units formed by crossing the plurality of data lines and the plurality of scan lines, wherein each of the plurality of pixel units includes a plurality of sub-pixel units; the plurality of sub-pixels in a same pixel unit are connected to a same data line, and are correspondingly connected to different scan lines.

The display panel further includes a data driving module configured to provide corresponding data signals to the plurality of data lines, and a scan driving module configured to provide corresponding scan signals to the plurality of scan lines. The scan driving module includes a plurality of scan signal generating chips configured to generate scan signals.

The data driving module includes a pulse width modulating chip, a gamma correcting chip, a timing control chip, and a data signal generating chip. The pulse width modulating chip is configured to control pulse widths of the data signals. The gamma correcting chip is configured to control signal intensities of the data signals, so as to adjust a frame displaying parameter. The timing control chip is configured to control timing of producing the data signals. The data signal generating chip is configured to generate the data signals.

The pulse width modulating chip and the gamma correcting chip are disposed on a printed circuit board. The timing control chip and the data signal generating chip are disposed on a flexible circuit board. The printed circuit board is connected to the plurality of data lines through the flexible circuit board.

Preferably, the plurality of sub-pixels in the same pixel unit are disposed along an extending direction of the data line.

Preferably, each of the plurality of pixel units includes a red sub-pixel unit, a blue sub-pixel unit, and a green sub-pixel unit.

Preferably, the display panel has a resolution of 1920*1080 pixels.

Preferably, the display panel includes 1920 data lines and 3240 scan lines.

Preferably, the scan driving module includes 6 scan signal generating chips each of which has 540 channels, and the data driving module includes 2 data signal generating chips each of which has 960 channels.

Preferably, the timing control chip and the data signal generating chip are disposed on the flexible circuit board in a COF form.

Preferably, the timing control chip communicates with the data signal generating chip using a P2P protocol.

Preferably, the timing control chip communicates with the data signal generating chip using a mini-LVDS protocol.

A specific operating principle of the display device, in accordance with the present preferred embodiment of the present disclosure, is the same as or similar to a description of the display panel in the aforementioned preferred embodiment. Refer to the relevant description of the display panel in the aforementioned preferred embodiment for specifics.

The display panel and the display device of the present disclosure increase the number of the scan lines, thereby effectively decreasing the number of the data lines. Because the number of data lines that gets reduced is more than the number of scan lines that is increased, the number of control chips in the data driving module may be effectively reduced. Meanwhile, the timing control chip and the data signal generating chip in the data driving module are disposed on the flexible circuit board, thereby effectively decreasing volume of the data driving module. Therefore, border volume of the display panel is decreased, and the data driving module has a simple structure and low manufacturing cost. Hence, the technical problem of the existing display panel and display device which have larger volume, a more complicated driving circuit structure, and higher manufacturing cost is effectively solved.

In summary, although the present disclosure has been described with preferred embodiments thereof above, it is not intended to be limited by the foregoing preferred embodiments. Persons skilled in the art can carry out many changes and modifications to the described embodiments without departing from the scope and the spirit of the present disclosure. Therefore, the protection scope of the present disclosure is in accordance with the scope defined by the claims.

What is claimed is:

1. A display panel, comprising: a plurality of data lines, a plurality of scan lines, and a plurality of pixel units formed by crossing the plurality of data lines and the plurality of scan lines, wherein each of the plurality of pixel units comprises a plurality of sub-pixel units; the plurality of sub-pixels in a same pixel unit are connected to a same data line, and are correspondingly connected to different scan lines;

wherein the display panel further comprises a data driving module configured to provide corresponding data signals to the plurality of data lines, and a scan driving module configured to provide corresponding scan signals to the plurality of scan lines;

wherein the data driving module comprises a pulse width modulating chip configured to control pulse widths of the data signals, a gamma correcting chip configured to control signal intensities of the data signals, so as to adjust a frame displaying parameter, a timing control chip configured to control timing of producing the data signals, and a data signal generating chip configured to generate the data signals;

wherein the pulse width modulating chip and the gamma correcting chip are disposed on a printed circuit board, the timing control chip and the data signal generating chip are disposed on a flexible circuit board, and the printed circuit board is connected to the plurality of data lines through the flexible circuit board; and wherein the plurality of sub-pixels in the same pixel unit are disposed along an extending direction of the data line.

2. A display panel, comprising: a plurality of data lines, a plurality of scan lines, and a plurality of pixel units formed by crossing the plurality of data lines and the plurality of scan lines, wherein each of the plurality of pixel units comprises a plurality of sub-pixel units; the plurality of sub-pixels in a same pixel unit are connected to a same data line, and are correspondingly connected to different scan lines;

wherein the display panel further comprises a data driving module configured to provide corresponding data signals to the plurality of data lines, and a scan driving module configured to provide corresponding scan signals to the plurality of scan lines; and wherein the data driving module comprises a pulse width modulating chip configured to control pulse widths of the data signals, a gamma correcting chip configured to control signal intensities of the data signals, so as to adjust a frame displaying parameter, a timing control chip configured to control timing of producing the data signals, and a data signal generating chip configured to generate the data signals, wherein the pulse width modulating chip and the gamma correcting chip are disposed on a printed circuit board, the timing control chip and the data signal generating chip are disposed on a flexible circuit board, and the printed circuit board is connected to the plurality of data lines through the flexible circuit board.

3. The display panel of claim 2, wherein the plurality of sub-pixels in the same pixel unit are disposed along an extending direction of the data line.

4. The display panel of claim 3, wherein each of the plurality of pixel units comprises a red sub-pixel unit, a blue sub-pixel unit, and a green sub-pixel unit.

5. The display panel of claim 2, wherein the display panel has a resolution of 1920*1080 pixels, and the display panel comprises 1920 data lines and 3240 scan lines.

6. The display panel of claim 5, wherein the scan driving module comprises 6 scan signal generating chips each of which has 540 channels, and the data driving module comprises 2 data signal generating chips each of which has 960 channels.

7. The display panel of claim 2, wherein the timing control chip and the data signal generating chip are disposed on the flexible circuit board in a chip-on-film form.

8. The display panel of claim 7, wherein the timing control chip communicates with the data signal generating chip using a P2P protocol.

9. The display panel of claim 7, wherein the timing control chip communicates with the data signal generating chip using a mini-LVDS protocol.

10. A display device, comprising: a display panel, wherein the display panel comprises a plurality of data lines, a plurality of scan lines, and a plurality of pixel units formed by crossing the plurality of data lines and the plurality of scan lines, wherein each of the plurality of pixel units comprises a plurality of sub-pixel units; the plurality of sub-pixels in a same pixel unit are connected to a same data line, and are correspondingly connected to different scan lines;

wherein the display panel further comprises a data driving module configured to provide corresponding data signals to the plurality of data lines, and a scan driving module configured to provide corresponding scan signals to the plurality of scan lines; and wherein the data driving module comprises a pulse width modulating chip configured to control pulse widths of the data signals, a gamma correcting chip configured to control signal intensities of the data signals, so as to adjust a frame displaying parameter, a timing control chip configured to control timing of producing the data signals, and a data signal generating chip configured to generate the data signals, wherein the pulse width modulating chip and the gamma correcting chip are disposed on a printed circuit board, the timing control chip and the data signal generating chip are disposed on a flexible circuit board, and the printed circuit board is connected to the plurality of data lines through the flexible circuit board.

11. The display device of claim 10, wherein the plurality of sub-pixels in the same pixel unit are disposed along an extending direction of the data line.

12. The display device of claim 11, wherein each of the plurality of pixel units comprises a red sub-pixel unit, a blue sub-pixel unit, and a green sub-pixel unit.

13. The display device of claim 11, wherein the display panel has a resolution of 1920*1080 pixels, and the display panel comprises 1920 data lines and 3240 scan lines.

14. The display device of claim 13, wherein the scan driving module comprises 6 scan signal generating chips each of which has 540 channels, and the data driving module comprises 2 data signal generating chips each of which has 960 channels.

15. The display device of claim 10, wherein the timing control chip and the data signal generating chip are disposed on the flexible circuit board in a chip-on-film form.

16. The display device of claim 15, wherein the timing control chip communicates with the data signal generating chip using a P2P protocol.

17. The display device of claim 16, wherein the timing control carp communicates with the data signal generating chip using a mini-LVDS protocol.

* * * * *